United States Patent [19]

Gallaro et al.

[11] 4,377,768

[45] Mar. 22, 1983

[54] DATA DISPLAY CRT HAVING A WHITE-EMITTING SCREEN

[75] Inventors: Anthony V. Gallaro, Auburn; Robert A. Hedler, Seneca Falls, both of N.Y.

[73] Assignee: North American Philips Consumer Electronics Corp., New York, N.Y.

[21] Appl. No.: 272,608

[22] Filed: Jun. 11, 1981

[51] Int. Cl.[3] ..... H01J 29/10

[52] U.S. Cl. ..... 313/467

[58] Field of Search ..... 313/467

[56] References Cited

U.S. PATENT DOCUMENTS 4,151,442 4/1979 Koga et al. ..... 313/467

*Primary Examiner*—Palmer C. Demeo

*Assistant Examiner*—Sandra L. O'Shea

*Attorney, Agent, or Firm*—Thomas A. Briody; Jack Oisher; John C. Fox

[57] ABSTRACT

The invention provides an advantageous blend of green, orange and blue-emitting phosphors to constitute an improved white-emitting screen component in a data display CRT. The improved white-emitter evidences medium-long persistence and thereby provides flicker-free imagery when the tube is expeditiously employed in conjunction with field refresh rates of 20 to 40 Hz.

8 Claims, 2 Drawing Figures

DATA DISPLAY CRT HAVING A WHITE-EMITTING SCREEN

REFERENCE TO RELATED APPLICATIONS

This application contains matter related to but not claimed in United States patent application filed concurrently herewith and assigned to the assignee of the present invention. The related application is Ser. No. 272,610.

TECHNICAL FIELD

This invention relates to a monochrome data display cathode ray tube (CRT) and more particularly to a tube employing a screen formed of a blend of phosphors producing white color emission and exhibiting sufficient decay persistence to provide a substantially flicker-free image display at low refresh rates of operation.

BACKGROUND ART

White-emitting phosphor components for a CRT data display screen are selected according to certain characteristics, such as: color temperature, brightness and rate of decay or persistence. Due to the nature of data display applications, which may often portray substantially static imagery with periodic updating, it is desirable to have luminescent emission whereof substantially continuous and concentrated viewing will produce a minimum of eye fatigue.

In display tubes operated in accordance with present television standards of 525 horizontal scan lines per frame, each frame of information is scanned twice by the exciting electron beam. This rapidly moving beam travels from left to right and from top to bottom across the screen of the tube at a uniform sweep pitched at a slightly downward slope. At the end of each horizontal line, the beam is returned, at a greater velocity, to the left side of the screen by an action known as horizontal retrace. Simultaneously to the horizontal sweep and retrace, each scan of the beam is pulled downward by the vertical sweep. When the horizontal sweep reaches the bottom of the screen, the vertical retrace returns the beam back to the top of the screen for the next scan. In this manner, each vertical sweep of the screen is accompanied by 262.5 horizontal sweeps and, as such, forms a "field" which contains only half of the display imagery of a complete frame. The first vertical sweep of each frame, known as the "odd field", fills the odd-numbered lines of the 525 in order from top to bottom, while the related second vertical sweep or "even field" fills in the even-numbered lines of the frame. The combining of these "odd and even fields", each comprising 262.5 lines, is known as interlaced scanning.

By conventional television standards, each vertical sweep or field is accomplished in 1/60 of a second or 16.66+ milliseconds. This frequency of field scanning is designated as a repeat or refresh rate of 60 Hertz (Hz). Since two fields constitute a complete 525-line frame of display imagery, the frequency rate of frame production is thirty per second, or once every 33.33+ milliseconds.

Cathodoluminescent phosphors employed in CRT screens exhibit two related luminescent characteristics: fluorescence and phosphorescence. Fluorescence is the luminescent build-up or emission of light released from the phosphor during the time of electron beam excitation. The duration of phosphorescence, or rate of decay of afterglow, is denoted as persistence. This is usually expressed as a measurement of time required for the phosphorescence to reduce or decay to a ten percent level of steady state fluorescent brightness.

Phosphors selected for utilization in data display CRT's operated in accordance with the aforedescribed interlaced scanning at a 60 Hz rate of refresh, exhibit decay persistences substantially within the range of 500 microseconds (μsec) to one millisecond (M sec), and as such are generally classified as having medium to medium-short persistences. These phosphors, when excited under the aforenoted operating conditions in conjunction with the visual persistence acuity of the human eye, provide a display which is interpreted by the observer as flicker-free imagery.

It has been found that a marked reduction in terminal equipment costs can be realized by utilizing less expensive components and circuitry to provide a scan refresh rate less than the conventional 60 Hz. But, when an economical rate of field refresh, for example in the order of 20 to 40 Hz, is employed in exciting CRT screens comprised of conventional medium persistence phosphors, noticeable flicker or brightness variation becomes evident in the screen display. This produces a deleterious viewing situation which is both distracting and fatiguing for the operator of the data display terminal.

DISCLOSURE OF THE INVENTION

It is therefore an object of the invention to reduce and obviate the aforementioned disadvantages evidenced in the prior art. Another object of the invention is the provision of a monochrome data display CRT employing a medium-long persistence white-emitting screen component substantially defined by C.I.E. color coordinates having an "x" value in the order of 0.275±0.015 and a "y" value of 0.295±0.010. The white luminescence evidences a nominal color temperature in the order of 10,600° K.+18 MPCD (minimum perceptible color difference) at an excitation of 15 KV and 50 microamperes. This white-emitter is comprised of a blend of known phosphors evidencing persistence characteristics capable of producing a substantially flicker-free image display at scanning refresh rates substantially within the range of 20 to 40 Hz. For example, a 30 Hz refresh rate is 33.33+ milliseconds.

The white-emitting phosphor blend is comprised of a green-emitting phosphor evidencing a medium-long persistence and exhibiting a bright excited hue substantially defined by C.I.E. color coordinates having an "x" value in the order of 0.210±0.010 and a "y" value of substantially 0.700±0.010.

A second element in the blend is an orange-emitting phosphor evidencing a medium-long persistence and exhibiting a bright hue substantially defined by color coordinates having an "x" value in the order of 0.550±0.010 and "y" value of substantially 0.440±0.010.

A third element in the blend is a blue-emitting phosphor evidencing medium persistence and exhibiting an excited hue substantially defined by color coordinates having an "x" value in the order of 0.145±0.010 and a "y" value of substantially 0.060±0.005. The resulting blend of the three contributors produces a bright white-emitting component that is aesthetically appealing for data display presentations.

BEST MODE FOR CARRYING OUT THE INVENTION

For a better understanding of the present invention, together with other and further objects, advantages and capabilities thereof, reference is made to the following disclosure and appended claims taken in conjunction with the aforedescribed drawings.

Figure 1:
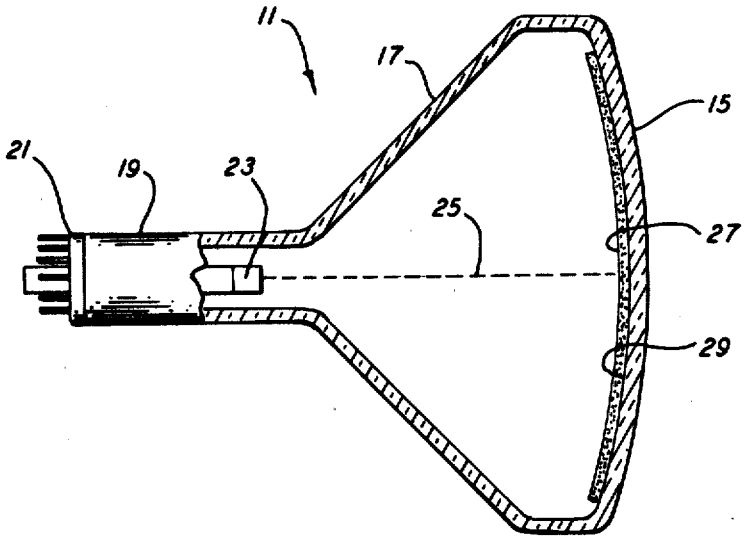
FIG. 1 is a partially sectioned monochrome data display CRT wherein the invention is utilized.

With reference to the drawings, there is shown in FIG. 1 a monochrome data display CRT 11 comprising an evacuated envelope 13 having a viewing panel portion 15, a funnel portion 17 and a restricting neck portion 19. Attached to the terminal end of the neck portion 19 is an insulative base 21 which has electrical conductive means therethrough for connecting the tube electrodes with their associated receiver circuitry. Within the neck portion 19 there is mounted an electron generating means 23 from which emanates at least one predetermined electron beam 25 which is utilized in the operation of the tube. A cathodoluminescent screen 27, comprised of the white-emitting blend of phosphor materials of the invention, is formed by conventional techniques on the interior surface 29 of the light transmissive viewing panel 15.

Figure 2:
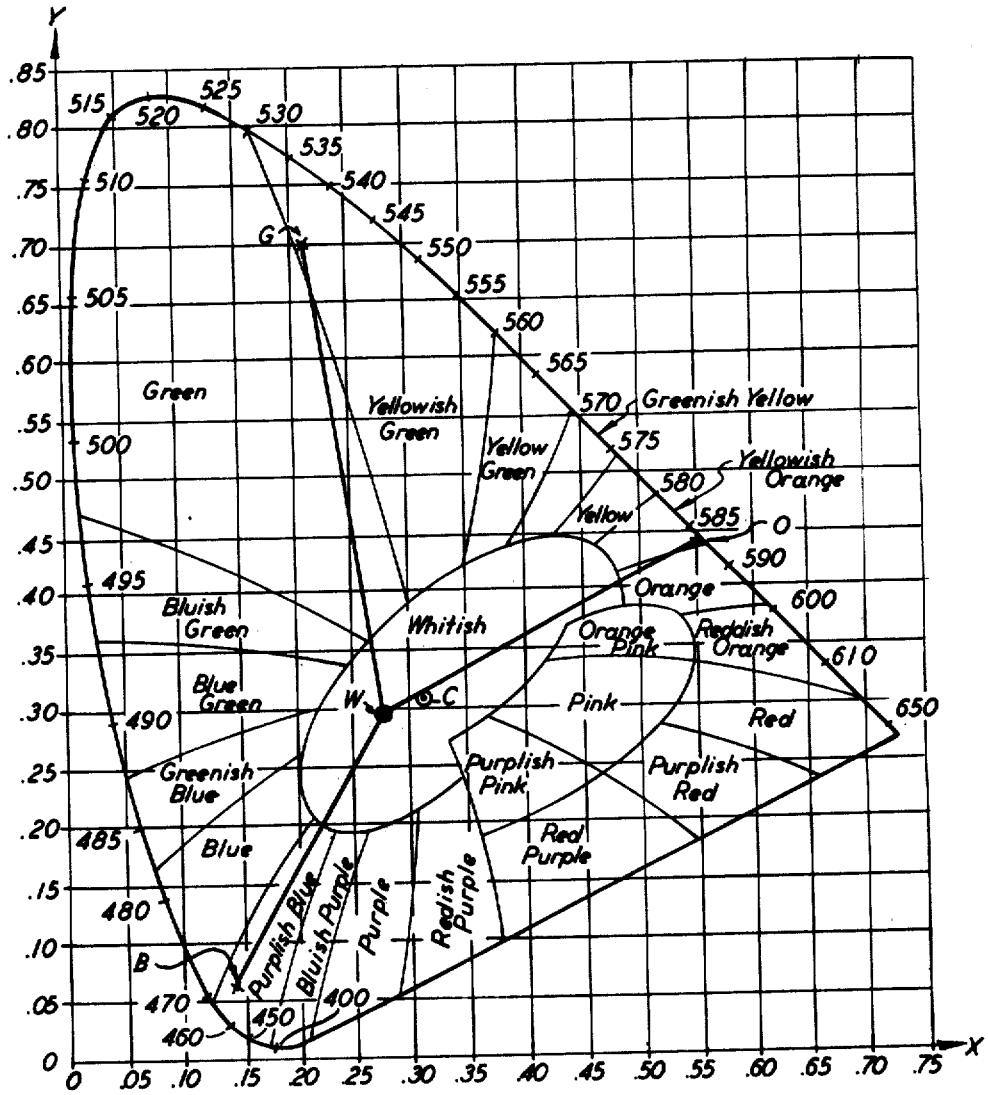
FIG. 2 illustrates a standard C.I.E. chromaticity diagram wherein the exemplary color coordinates of the invention are defined.

To facilitate description of the composition and response of the white-emitting phosphor component of the invention, reference is directed to FIG. 2 wherein there is shown a standard C.I.E. (Commission Internationale d'Eclairge) chromaticity diagram whereupon definitive "x" and "y" color coordinates may be plotted to designate specific hues. The periphery of the horseshoe-shaped figure defines a monochrome locus of which the blue and red ends of the spectrum are spanned by a line forming a locus of pure purple. Encompassed within the loci of the chromaticity diagram is a range of colors comprising the visible spectrum to which the normal human eye is sensitive. A sequential series of numbers, noted adjacent to the loci, indicate pure spectral wavelengths expressed in nanometers (nm). Thus, the hue of any color can be defined in terms of "x" and "y" coordinates.

The central area of the diagram is the "whitish" region, and as the hue designations approach this region, the colors become less saturated, i.e., they contain more white. Shown is Illuminant "C", which is very nearly average daylight, having a color temperature of about 6800° K. Such is substantially delineated by "x" and "y" coordinates of 0.310 and 0.316, respectively.

The invention relates to a data display CRT wherein the monochrome screen is formed of a distinctive white-emitting component comprised of a homogeneous blend of three discretely chosen known phosphors emitting hues of green, orange and blue, respectively. Each of these contributors evidences a desired hue, brightness, burn resistance and sufficient persistence to produce a substantially flicker-free monochrome image display at a field refresh rate of 20 to 40 Hz. Because of the prevalence of substantially static display, with periodic revisions, phosphor burn resistance is an important consideration in data display screens. The respective phosphors utilized herein are found to be substantially equivalents in burn resistance.

For this description, the invention is incorporated into a 12-inch solid screen CRT. The brightness is measured in foot lamberts resulting from an operating anode voltage of substantially 15 KV and a beam current density of 50 microamperes. The brightness values measured in a monochrome CRT application, as described herein, are brighter than those evidenced in a multicolor tube having a foraminous mask or grid member oriented adjacent to a patterned screen.

In this instance, the persistence characteristics relate to the intervals of phosphorescent decay to ten percent of steady state brightness, such being measured of a pulsed spot excited to full luminance by substantially 15 KV and 0.3 microampere excitation. Persistence measured by the spot technique tends to produce readings of lower values than those obtained by the method employing evaluation of line scan excitation.

The green-emitting portion of the blend is a zinc orthosilicate host co-activated with manganese and arsenic ($Zn_2SiO_4$:Mn:As). This selected known material exhibits a hue denoted as "G" in the C.I.E. diagram of FIG. 2 and is substantially defined as having an "x" value in the order of $0.210\pm0.010$ and a "y" value in the order of $0.700\pm0.010$. Individually, this phosphor in monochrome usage is found to exhibit a brightness or intensity of substantially 50 foot lamberts. Thus, this contributing green-emitter is the brightest element in the blend. Its persistence is evidenced as medium-long, being substantially in the order of at least 32 milliseconds.

The orange-emitting portion of the white-emitter is a cadmium silicate host co-activated with manganese and arsenic ($CdSiO_3$:Mn:As). Its hue is denoted as "O" in the C.I.E. diagram of FIG. 2 and is substantially defined as having an "x" value in the order of $0.550\pm0.010$ and a "y" value in the order of $0.440\pm0.010$. Individually, this phosphor is found to exhibit a brightness of substantially 30.0 foot lamberts. Its persistence is evidenced as medium-long, being in the order of at least 35 milliseconds.

The blue-emitting portion of the blend is a zinc sulfide host activated with silver (ZnS:Ag) and is designated as "B" in FIG. 2. It is defined by color coordinates whereof the "x" value is in the order of $0.145\pm0.010$ and the "y" value in the order of $0.060\pm0.005$. Its individual brightness is substantially 33 foot lamberts, while its evidenced persistence is rated as medium, being somewhat less than one millisecond. Thus, it contributes little persistence, but furnishes necessary tonal value to the blend.

The blending of the three aforenoted phosphors to achieve the desired white-emitter of medium-long persistence is accomplished by homogeneously mixing substantially: $60\pm2$ weight percent of orange-emitting $CdSiO_3$:Mn:As, $25\pm2$ weight percent of green-emitting $Zn_2SiO_4$:Mn:As, and $15\pm2$ weight percent of blue-emitting ZnS:Ag. This constituted blend of phosphors exhibits a bright white-emission substantially defined by C.I.E. color coordinates having an "x" value in the order of $0.275\pm0.015$ and a "y" value in the order of $0.295\pm0.010$. Its nominal color temperature, at excitation of substantially 15 KV and 50 ua, is in the order of 10,600° K. (+18 MPCD) and is designated by "W" in FIG. 2. The brightness of the blend is approximately 37 foot lamberts; and the evidenced persistence is desirably medium-long, being in the order of at least 28 milliseconds. The tonal emission of the blend is eye-pleasing to the observer, and fully satisfies the requirements of refresh rates in the range of 20 to 40 Hz. This discrete medium-long persistence blend offers markedly improved overall performance in terms of freedom from flicker, brightness, color rendition and burn resistance, when compared with previously used blends.

While this white-emitting component is herein described as the luminescent emitter in a monochrome data display CRT, it is evident that this particular blend of phosphors can also be utilized as a medium-long persistence white-emitting portion of a plural component multi-color CRT screen, if such is desired. Such breadth is considered to be within the scope of the invention and coverage for the same is therefore included in the appended claims.

While there has been shown and described what are presently considered to be the preferred embodiments of the invention, it will be obvious to those skilled in the art that various changes and modifications may be made therein without departing from the intended scope of the invention as defined by the appended claims.

INDUSTRIAL APPLICABILITY

The data display CRT utilizing the delineated white-emitting blend is a marked advancement in the art. The selection of contributing phosphors relative to hue, brightness, burn resistance and persistence enables the fabrication of a screen that is efficiently responsive to field refresh rates of 20 to 40 Hz. The usage of such tubes enables the economical construction of display terminals incorporating less expensive components and simplified circuitry. In addition, the color rendition is both pleasing to the eye and viewable with a minimum of fatigue.

What is claimed is:

1. A monochrome data display cathode ray tube having means for forming and directing an electron beam to impinge a cathodoluminescent screen evidencing medium-long image persistence disposed in the viewing area, such being constituted of a bright white-emitting screen component substantially defined by C.I.E. color coordinates having an "x" value in the order of 0.275±0.015 and a "y" value in the order of 0.295±0.010 and exhibiting a nominal color temperature in the order of 10,600° K. (+18 MPCD), at substantially 15 KV, 50 ua excitation, said white-emitting screen component being formed of a discrete blend of phosphors comprising:

a medium-long persistence green-emitting phosphor evidencing an excited hue substantially defined by C.I.E. color coordinates having an "x" value in the order of 0.210±0.010 and a "y" value in the order of 0.700±0.010;

a medium-long persistence orange-emitting phosphor evidencing an excited hue substantially defined by C.I.E. color coordinates having an "x" value in the order of 0.550±0.010 and a "y" value in the order of 0.440±0.010; and a medium persistence blue-emitting phosphor exhibiting an excited hue substantially defined by C.I.E. color coordinates having an "x" value in the order of 0.145±0.010 and a "y" value in the order of 0.060±0.005.

2. The monochrome data display cathode ray tube according to claim 1 wherein said green-emitting phosphor evidences a persistence of at least 32 milliseconds, said orange-emitting phosphor a persistence of at least 35 milliseconds, and said blue-emitting phosphor having a persistence of less than 1 millisecond, and wherein said white-emitting blend a persistence of at least 28 milliseconds.

3. The monochrome data display cathode ray tube according to claim 1 wherein the white-emitting cathodoluminescent screen component is a blend of phosphors evidencing persistence characteristics capable of producing a substantially flicker-free image display at scanning refresh rates substantially within the range of 20 to 40 Hz.

4. The monochrome data display cathode ray tube according to claim 1 wherein said green-emitting phosphor is a zinc orthosilicate host co-activated with manganese and arsenic ($Zn_2SiO_4$:Mn:As).

5. The monochrome data display cathode ray tube according to claim 1 wherein said orange-emitting phosphor is a cadmium silicate host co-activated with manganese and arsenic ($CdSiO_3$:Mn:As).

6. The monochrome data display cathode ray tube according to claim 1 wherein said blue-emitting phosphor is a zinc sulfide host activated with silver (ZnS:Ag).

7. The monochrome data display cathode ray tube according to claim 1 wherein said blend of phosphors substantially comprises: 60±2 weight percent of orange-emitting $CdSiO_3$:Mn:As, 25±2 weight percent of green-emitting $Zn_2SiO_4$:Mn:As and 15±2 weight percent of blue-emitting ZnS:Ag.

8. A medium-long persistence white emitting cathodoluminescent phosphor component for use in a data display CRT screen, said component being a blend of phosphors substantially comprising: 60±2 weight percent of orange-emitting $CdSiO_3$:Mn:As; 25±2 weight percent of green-emitting $Zn_2SiO_4$:Mn:As; and 15±2 weight percent of blue-emitting ZnS:Ag.

* * * * *